US006768884B1

(12) United States Patent
Buchheit

(10) Patent No.: US 6,768,884 B1
(45) Date of Patent: Jul. 27, 2004

(54) SYSTEM AND METHOD OF PRINTER/ COPIER ACTIVE LINE CURRENT CONTROL

(75) Inventor: Robert F. Buchheit, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/355,751

(22) Filed: Jan. 31, 2003

(51) Int. Cl.[7] ..... G03G 15/00
(52) U.S. Cl. ..... 399/88
(58) Field of Search ..... 219/216; 399/67, 399/69, 70, 75, 88

(56) References Cited

U.S. PATENT DOCUMENTS 5,881,335 A 3/1999 Yang ..... 399/70
6,353,899 B1 3/2002 Martin et al. ..... 714/57
6,393,233 B1 * 5/2002 Soulier ..... 399/88
6,591,073 B1 * 7/2003 Fujii ..... 399/88

* cited by examiner

*Primary Examiner*—Hoang Ngo
(74) *Attorney, Agent, or Firm*—Fay, Sharpe, Fagan, Minnich & McKee, LLP

(57) ABSTRACT

A method of controlling line current $I_L$ drawn by a printer/copier through a line cord connecting the printer to a power source. The method includes the monitoring line current $I_L$ and reducing available printer/copier functionality when the line current exceeds a predetermined value $I_T$ to keep the line current from exceeding predetermined maximum value $I_{max}$. A printer/copier includes a line cord connecting the printer to an AC power source for providing line current to the printer for printer operation. The printer/copier also includes a current monitor for monitoring line current drawn by the printer through the line cord. The printer/copier also includes a printer/copier functionality controller communicating with the current monitor for reducing printer/copier functionality when the line current exceeds a predetermined value $I_T$ to keep the line current from exceeding predetermined maximum value $I_{max}$.

24 Claims, 2 Drawing Sheets

SYSTEM AND METHOD OF PRINTER/COPIER ACTIVE LINE CURRENT CONTROL

BACKGROUND OF THE INVENTION

The present invention relates generally to printer/copier machines, and more particularly a system and method to prevent printer/copier line current from exceeding predetermined limits.

Printer/copier machines can provide a wide range of functions for the user. As used herein, the term printer/copier applies to any printer, or copier, or multifunction machine which can print and/or copy, as well as perhaps, perform other functions such as scanning, etc. One subgroup of printer/copiers generate printed words or images on paper using the process of electrophotographic reproduction. Copiers reproduce an image of an original document to be copied placed onto the surface of a photoreceptor (or a photoconductive member) either by illuminating the original document, which is projected upon the photoreceptor to produce a latent electrostatic image corresponding to the original document, or by placing the image onto the photoreceptor by electronic means. The latent electrostatic image is developed by a fuser fusing particles to produce a visible toner image that is transferred to the paper or other substrate. The unfused toner image may be fixed to the substrate by means of heat and pressure by pressing the substrate through the nip of a pair of rollers, at least one of which is heated.

Printer/copiers must meet a number of design constraints. Customer demands and marketing forces impose criteria including the functions the machines should provide for a user.

Other constraints are imposed by regulatory agencies such as limitations on the current $I_{max}$ drawn by the device through the line cord. The current drawn from the power source through the line cord can vary and exceed these current limits resulting in an overcurrent condition. Typically, a printer/copier reacts to an overcurrent condition by shutting down, which can inconvenience the user. It is desirable to provide a more user friendly printer/copier response to conditions which can lead to an overcurrent situation.

SUMMARY OF THE INVENTION

A system and method to prevent printer/copier line current from exceeding predetermined limits.

In accordance with a first aspect of the invention a method of controlling line current $I_L$ drawn by a printer/copier through a line cord connecting the printer to a power source is provided. The method includes the monitoring line current $I_L$ and reducing available printer/copier functionality when the line current exceeds a predetermined value $I_T$ to keep the line current from exceeding predetermined maximum value $I_{max}$.

In accordance with a second aspect of the invention, a printer/copier is provided. The printer/copier includes a line cord connecting the printer to an AC power source for providing line current to the printer for printer operation. The printer/copier also includes a current monitor for monitoring line current drawn by the printer through the line cord. The printer/copier also includes a printer/copier functionality controller communicating with the current monitor for reducing printer/copier functionality when the line current exceeds a predetermined value $I_T$ to keep the line current from exceeding predetermined maximum value $I_{max}$.

Other features, benefits and advantages of this invention will become apparent to those skilled in the art from the following detailed description of the preferred embodiments, when read in light of the accompanying drawings.

BRIEF DESCRIPTION OF THE DRAWINGS

The drawings are only for purposes of illustrating preferred embodiments and are not to be construed as limiting the invention. The invention may take form in various components and arrangements of components, and in various steps and arrangements of steps, preferred embodiments of which will be illustrated in the accompanying drawings wherein.

DETAILED DESCRIPTION OF THE INVENTION

It is to be understood that the specific devices and processes illustrated in the attached drawings, and described in the following specification are simply exemplary embodiments of the inventive concepts defined in the appended claims. Hence, specific examples and characteristics relating to the embodiments disclosed herein are not to be considered as limiting, unless the claims expressly state otherwise.

Figure 1:
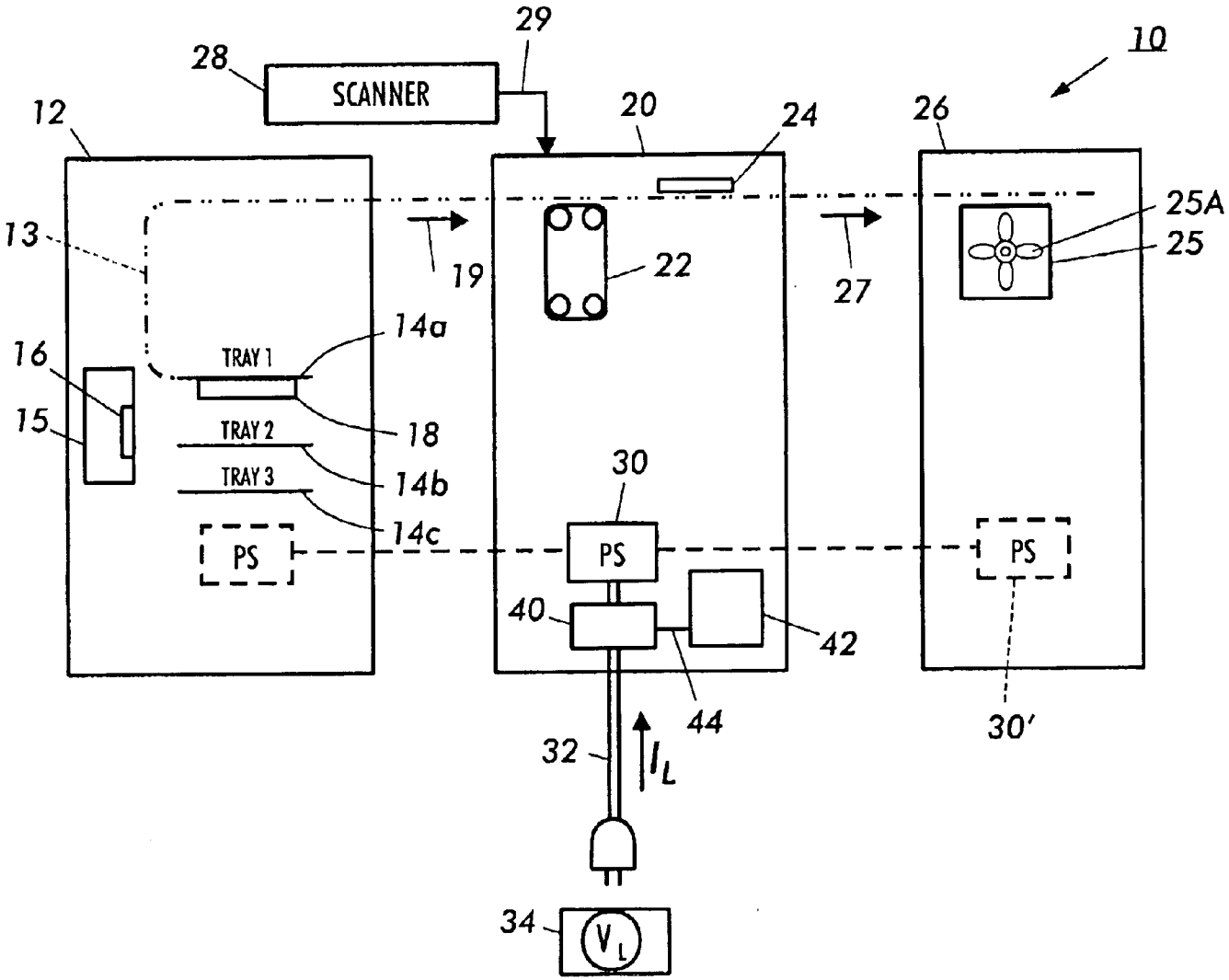
FIG. 1 is block diagram illustrating a printer/copier in accordance with the invention.

Referring now to FIG. 1, a printer/copier is shown generally at 10. The invention is applicable to any known printer/copier. The printer/copier 10 can include a feeder module 12 for feeding a substrate, including but not limited to paper, along a process route shown at 13. The substrate is fed from one or more trays, a plurality of which are shown at 14*a*–14*c*. The feeder 12 can include a fluffer 15 having a heater 16 for using heated air to separate the individual pieces of substrate in a known manner. The feeder module 12 can also include one or more tray heaters, one of which is shown at 18, for reducing humidity in the vicinity of the substrate trays to improve substrate separation prior to feeding the substrate. The feeder feeds the separated substrates for printing and/or copying as shown by the dashed line and the arrow 19 at a feed rate that can determine, at least in part, the copy rate or the print rate.

The printer/copier 10 can also include an electrophotographic processor module 20 for generating print and/or an image on the substrate in a suitable known manner. The electrophotographic processor 20 can include a photoreceptor 22 and fuser 24 disposed along the process route 13 for transferring the image to the substrate in a known manner. Alternatively, the printer/copier 20 can form/print the image on the substrate in any other known manner.

The printer/copier 10 can also include a finisher module 26. The finisher receives the substrate with image from the electrophotographic processor 20 as shown by the arrow at 27. The finisher 26 can provide a wide range of substrate handling functions including but not limited to grouping, sorting, stapling, hole punching, etc. The printer/copier 10 can also include a substrate cooler 25 for cooling the substrate after the image is formed on it. The substrate cooler 25 can be located in any suitable location along the process route 13 in the printer/copier 10, such as for example, in the finisher module 26. The substrate cooler 25 can cool the substrate in any suitable known manner, including but not limited to, blowing air on the substrate.

The printer/copier 10 can also include a scanner module 28 for providing an image in electronic form to the electrophotographic processor module 20 at 29 in any suitable known manner for transfer to the substrate in any suitable known manner.

The printer/copier 10 also includes a power supply 30 for providing power to the printer/copier. The power supply 30 can include a plurality of separate power supplies, shown with dashed lines at 30', distributed to one or more of the printer/copier modules for providing power thereto. The power supply 30 can be any suitable known power supply for powering the printer/copier, including but not limited to a switching power supply.

A line cord 32 connects the power supply 30 to a power source 34. The power source 34 can be any suitable known source for providing power to a printer/copier 10 such as, for example, a wall socket. During operation, the printer/copier power supply 30 draws line current from the power source 34 through the line cord 32 as shown by the arrow marked $I_L$.

It has been found that the printer/copier power supply 30 typically acts as a constant power source attempting to provide an approximately constant amount of power to the printer/copier 10 while operating with a given functionality. Accordingly, when the line voltage $V_L$ at the power source 34 drops, the line current $I_L$ drawn through the line cord 32 increases maintaining the constant power condition. If the line voltage $V_L$ drops enough, the line current $I_L$ drawn through the line cord 32 will exceed a predetermined maximum value $I_{max}$. $I_{max}$ may be established by the manufacturer of the printer/copier 10 or it may be set by a regulatory agency where the printer/copier is used. For example, $I_{max}$ for a single line cord 32 operating at a $V_L$ of 208 V, may be set at 24 A, although $I_{max}$ can be any other suitable current value and $V_L$ may be any other suitable voltage.

The printer/copier 10 includes a current monitor 40 which monitors the line current $I_L$. The current monitor 40 can be any suitable known device for determining the value of the line current $I_L$ and for signaling when the line current exceeds a predetermined threshold current $I_T$. The printer/copier 10 also includes a functionality controller 42 communicating with the current monitor 40 at 44. The functionality controller 42 controls printer/copier functions by reducing the printer/copier functionality as described below to reduce the power used by the printer/copier 10 and thus reduce the line current $I_L$ as describe in further detail below.

Figure 2:
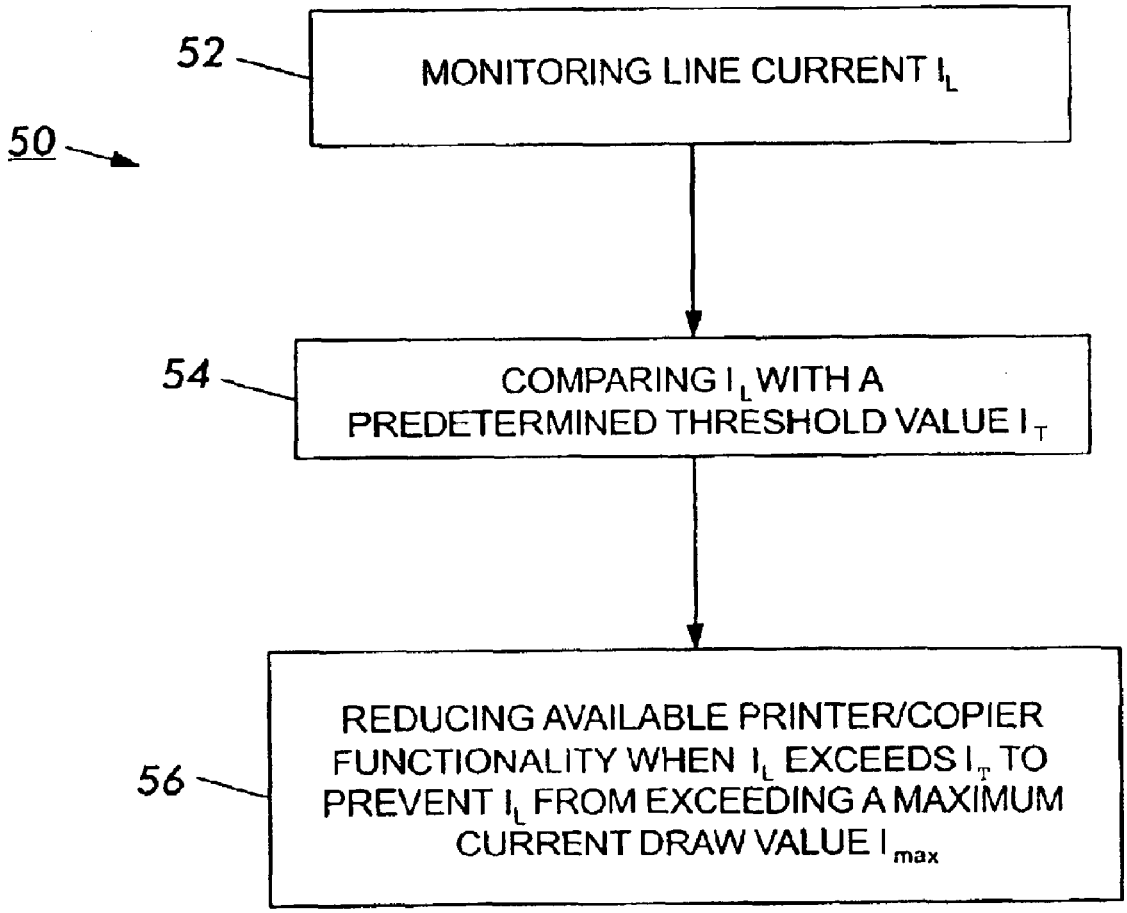
FIG. 2 illustrates method steps of the invention.

As shown generally at 50 in FIG. 2, the invention includes a method of controlling the line current $I_L$ drawn by the printer/copier 10 through a line cord 32 connecting the printer to a power source 34. The method includes the current monitor 40 monitoring the line current $I_L$ at 52 and comparing it to the predetermined threshold value $I_T$ at 54. When the line voltage $V_L$ drops, such as occurs during a temporary low line voltage condition, the line current $I_L$ increases and can exceed the threshold value $I_T$. The threshold current value $I_T$ will be equal to or less than the maximum allowable current $I_{max}$. When the current monitor 40 determines that the line current $I_L$ exceeds the threshold value $I_T$, the current monitor communicates this event to the functionality controller 42 via the communication link 44. The method also includes the functionality controller 42 reducing available printer/copier functionality at 56 when the line current exceeds the predetermined value $I_T$ to keep the line current $I_L$ from exceeding the predetermined maximum allowable line current $I_{max}$.

Reducing the printer/copier functionality can include altering printer/copier functions, and/or disabling, turning off, or in any other suitable way making printer/copier functions unavailable which were previously unaltered and/or available when the line current $I_L$ did not exceed the threshold value $I_T$. Reducing printer/copier functionality in this manner reduces the power requirements of the printer/copier 10 therefore reducing the line current $I_L$ and preventing the line current $I_L$ from exceeding the maximum value $I_{max}$.

The functionality controller 42 can reduce the printer/copier functionality using software control, hardware control or any suitable combination thereof. The functionality controller 42 can reduce, disable, or otherwise make unavailable any single printer/copier function or any suitable combination of printer/copier functions in order to reduce the line current $I_L$.

Examples of reducing the printer/copier functionality can include, but are not limited to, reducing the thickness of substrate stock which the printer/copier can accommodate. This can be accomplished in any suitable known manner, including but not limited to, reducing the fusing temperature of the fuser in the electrophotographic processor.

Other examples of reducing the printer/copier functionality can include, but are not limited to, reducing the temperature of the fluffer heater, disabling the fluffer heater, disabling the fluffer, reducing the temperature of the tray heater, disabling the tray heater, reducing the speed of one or more substrate cooling devises such as cooling fans 25*a*, or disabling one or more of these substrate cooling devices.

Other examples of reducing the printer/copier functionality can include, but are not limited to, substrate handling functions performed by the finisher module, such as for example stapling and/or hole punching.

Other examples of reducing the printer/copier functionality can include, but are not limited to, reducing the copying and/or printing rate of the printer/copier 10. This can be accomplished in any suitable know manner, including but not limited to skipping pitches by reducing the number of images that are placed on the photo receptor 22, and/or reducing the process speed or feed rate of the substrate feeder 12, and/or increasing the gap between the substrates as they are fed to the electrophotographic processor 20.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

What is claimed is:

1. A method of controlling line current $I_L$ drawn by a printer/copier through a line cord connecting the printer to a power source comprising:

monitoring line current $I_L$ drawn by the printer through the line cord; and reducing printer/copier functionality without reducing the copying and/or printing rate when the line current exceeds a predetermined value $I_T$ to keep the line current from exceeding predetermined maximum value $I_{max}$.

2. The method defined in claim 1 further including comparing the line current $I_L$ with a predetermined value $I_T$.

3. The method defined in claim 1 wherein the reducing step includes reducing the thickness of the substrate stock which the printer/copier can accommodate.

4. The method defined in claim 1 wherein the printer/copier includes a fuser and the reducing step includes reducing the fuser fusing temperature.

5. The method defined in claim 1 wherein printer/copier includes a fluffer having a heater and the reducing step includes reducing the fluffer heater temperature.

6. The method defined in claim 1 wherein printer/copier includes a fluffer having a heater and the reducing step includes disabling the fluffer heater.

7. The method defined in claim 1 wherein printer/copier includes a fluffer having a heater and the reducing step includes disabling the fluffer.

8. The method defined in claim 1 wherein printer/copier includes a tray heater and the reducing step includes reducing the temperature of the tray heater.

9. The method defined in claim 1 wherein printer/copier includes a tray heater and the reducing step includes disabling the tray heater.

10. The method defined in claim 1 wherein printer/copier includes a substrate cooler and the reducing step includes disabling the substrate cooler.

11. The method defined in claim 1 wherein printer/copier includes a substrate cooler having a fan and the reducing step includes reducing the speed of the fan.

12. The method defined in claim 1 wherein the printer/copier includes a finisher module and the reducing step includes reducing the available substrate handling functions performed by the finisher module.

13. A method of controlling line current drawn by a printer/copier through a line cord connecting the printer to a power source comprising:

monitoring line current $I_L$ drawn by the printer through the line cord; and reducing available printer/copier functionality without reducing the copying and/or printing rate to keep the line current $I_L$ from exceeding a predetermined line current limit $I_{max}$.

14. An printer/copier comprising:

a line cord connecting the printer to an AC power source for providing line current to the printer for printer operation;

a current monitor for monitoring line current drawn by the printer through the line cord; and a printer/copier functionality controller communicating with the current monitor for reducing printer/copier functionality without reducing the copying and/or printing rate when the line current exceeds a predetermined value $I_T$ to keep the line current from exceeding predetermined maximum value $I_{max}$.

15. The method defined in claim 12 wherein the reducing step includes disabling substrate stapling.

16. The method defined in claim 12 wherein the reducing step includes disabling substrate hole punching.

17. The printer/copier defined in claim 14 further comprising:

a fuser, wherein the functionality controller reduces printer/copier functionality by reducing the fusing temperature of the fuser.

18. The printer/copier defined in claim 14 further comprising:

a fluffer having a heater, wherein the functionality controller reduces printer/copier functionality by disabling the fluffer.

19. The printer/copier defined in claim 14 further comprising:

a fluffer having a heater, wherein the functionality controller reduces printer/copier functionality by disabling the fluffer heater.

20. The printer/copier defined in claim 14 further comprising:

a fluffer having a heater, wherein the functionality controller reduces printer/copier functionality by reducing the temperature of the fluffer heater.

21. The printer/copier defined in claim 14 further comprising:

a tray heater, wherein the functionality controller reduces printer/copier functionality by disabling the tray heater.

22. The printer/copier defined in claim 14 further comprising:

a tray heater, wherein the functionality controller reduces printer/copier functionality by reducing the temperature of the tray heater.

23. The printer/copier defined in claim 14 further comprising:

a substrate cooler, wherein the functionality controller reduces printer/copier functionality by disabling the substrate cooler.

24. The printer/copier defined in claim 14 further comprising:

a substrate cooler having a cooling fan, wherein the functionality controller reduces printer/copier functionality by reducing the speed of the cooling fan.

* * * * *